United States Patent [19]

Lübke

[11] Patent Number: 4,545,730

[45] Date of Patent: Oct. 8, 1985

[54] LIQUID RING VACUUM PUMP FOR GASEOUS MEDIA

[75] Inventor: Wilfried Lübke, Ammerndorf, Fed. Rep. of Germany

[73] Assignee: Siemens Aktiengesellschaft, Berlin & Munich, Fed. Rep. of Germany

[21] Appl. No.: 628,959

[22] Filed: Jul. 9, 1984

Related U.S. Application Data

[63] Continuation of Ser. No. 389,893, Jun. 18, 1982, abandoned.

[30] Foreign Application Priority Data

Jun. 24, 1981 [DE] Fed. Rep. of Germany ..... 3124867

[51] Int. Cl.[4] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| Re. 29,747 | 8/1978 | Roe et al. | 417/68 X |
| 1,180,613 | 4/1916 | Siemen | 417/68 |
| 1,662,250 | 3/1928 | Jennings | 417/68 X |
| 3,721,508 | 3/1973 | Mugele | 417/68 |
| 3,884,596 | 5/1975 | Hoffmeister | 417/68 |
| 4,273,515 | 6/1981 | Fitch | 417/68 X |
| 4,323,334 | 4/1982 | Haavik | 417/68 |
| 4,392,783 | 7/1983 | Jozepaitis | 417/68 |

FOREIGN PATENT DOCUMENTS

| | | | |
|---|---|---|---|
| 477511 | 1/1953 | Italy | 417/68 |

OTHER PUBLICATIONS

Vacuum Pumps and Compressors, Siemens-System ELMO-F, No. E 727/1013.101, (May 1979).

*Primary Examiner*—Richard E. Gluck
*Attorney, Agent, or Firm*—Kenyon & Kenyon

[57] ABSTRACT

For improved operation of a liquid ring vacuum pump at lower suction pressures and avoiding erosion damage while eliminating pressure booster pumps or scooping tubes in circular operation as well as for simplified external control of the working liquid, an inflow channel is milled into the control disc behind the suction slot on the side facing the impeller, which channel is in communication with a pressurized liquid passage for gap sealing pressurized liquid. The pressurized liquid feed line is connected to a separator or to the machine sump. For improving the efficiency or the liquid output at higher suction pressures, a relief passage is also provided in the control disc above the pressure slot.

5 Claims, 4 Drawing Figures

LIQUID RING VACUUM PUMP FOR GASEOUS MEDIA

This application is a continuation of application Ser. No. 389,893 filed June 18, 1982 now abandoned.

BACKGROUND OF THE INVENTION

This invention relates to liquid ring vacuum pumps in general and more particularly to a liquid ring vacuum pump with improved operating characteristics.

A liquid ring vacuum pump for gaseous media of the type which has a machine housing which eccentrically surrounds an impeller and has its end faces closed off by end bells which also support the impeller shaft is known. In such pumps, at least one end bell has separate inlets and outlets for the medium. These are in communication with blade chambers of the impeller, which are closed at their circumference by a liquid ring, through suction and pressure slots in a flat control disc disposed between the end bell and the machine housing. A pressurized liquid canal for sealing liquid is formed in the end bell at a location between the inlets and outlets and is connected to a pressurized liquid feed line. The inlet of a pressurized liquid passage is formed in the control disc below the shaft passage therethrough, in the end face of the disc adjacent the impeller hub and is aligned with the pressurized liquid feed line so that pressurized liquid flows off into the liquid ring, sealing the gap. Such a liquid ring vacuum pump is described in "Vacuum Pumps and Compressors Siemens-System ELMO-F" Nr. E 725/1013.101 (May 79).

Under different operating conditions and modes of operation of liquid ring vacuum pumps, a number of disadvantages occur which to date it has not been possible to completely eliminate or mitigate. Thus, in vacuum pumps which operate with their working fluid extending in circular fashion, either separate pressure booster pumps or, instead, scooping tubes which dip into the rotating liquid ring are screwed into the machine housing on the suction side. In the latter case, erosion damage can occur at the machine housing in the vicinity of the scooping tube dipping into the liquid ring, which affects the life and the proper operation of the vacuum pump adversely.

In addition, gap losses occur in all modes of operation up to about 60 mbar suction pressure. This reduces the efficiency of the vacuum pump. The gap losses can be decreased only to a very limited extent by making the axial play of the impeller smaller because excessively small axial play limits the operating safety.

In vacuum pumps with a revolving liquid, which have a passage in the control disc for the suction liquid, i.e., a circulating water bore hole, appreciable erosion and/or cavitation damage occurs in the region of these passages at the control discs and impellers, which can be retarded only by using high quality material, e.g. CrNi steel, for these parts.

In liquid ring vacuum pumps of the type mentioned at the outset which, in the range of higher suction pressures, are to pump, in addition the gaseous medium, optionally also liquids, more power is required if liquids are also to be pumped, and a degradation of the running properties of the impeller occurs which can lead to premature wear of the bearings of the impeller. To reduce the increase in power requirements, and while maintaining the normal running properties, a separate preliminary separator is built into the suction line ahead of the vacuum pump which separates liquid, that may have already been taken along, from the gaseous medium ahead of the vacuum pump. These measures result in reduced efficiency when only gas is pumped.

The object of the present invention is an improvement of the operating properties, eliminating auxiliary devices which may be necessary in special cases but are expensive and trouble prone, as well as the avoidance of erosion damage in circular operation and/or simultaneous pumping of liquid accumulating on the suction side, in a liquid ring vacuum pump of the type described above,

SUMMARY OF THE INVENTION

The solution of the stated problem for eliminating erosion damage at control discs and impellers by parts of the working liquid and improved inflow conditions at these points with improved efficiency by reduced gap losses in the lower range of the suction pressure for the gas to be pumped is successfully achieved in circular operation without pressure booster pumps or scooping tubes by forming in the control disc, on the side facing the impeller, at least one inflow channel, located between the suction slot and output slot as seen in the direction of rotation of the impeller and below the shaft passage. The inflow channel extends over the region of the impeller hub up to the region of the blade chamber. In addition the sump of the vacuum pump or, if a separator is provided following the outlet in the end bell, i.e., the source of pressured liquid is connected exclusively to the pressurized liquid feed line leading to the pressurized liquid inlet in the control disc.

In pump operation in the higher range of suction pressures, the stated problem is successfully solved, in cases where working liquid is pumped simultaneously, namely, to achieve without a preliminary separator in the suction line, a reduction of the power required with better running properties, and without simultaneous pumping of working liquid, to obtain an improvement of the efficiency, by providing at least one relief passage for the liquid ring in the control disc above and separated from the output (pressure) slot and adjacent its outer contour.

DETAILED DESCRIPTION

Figure 3:
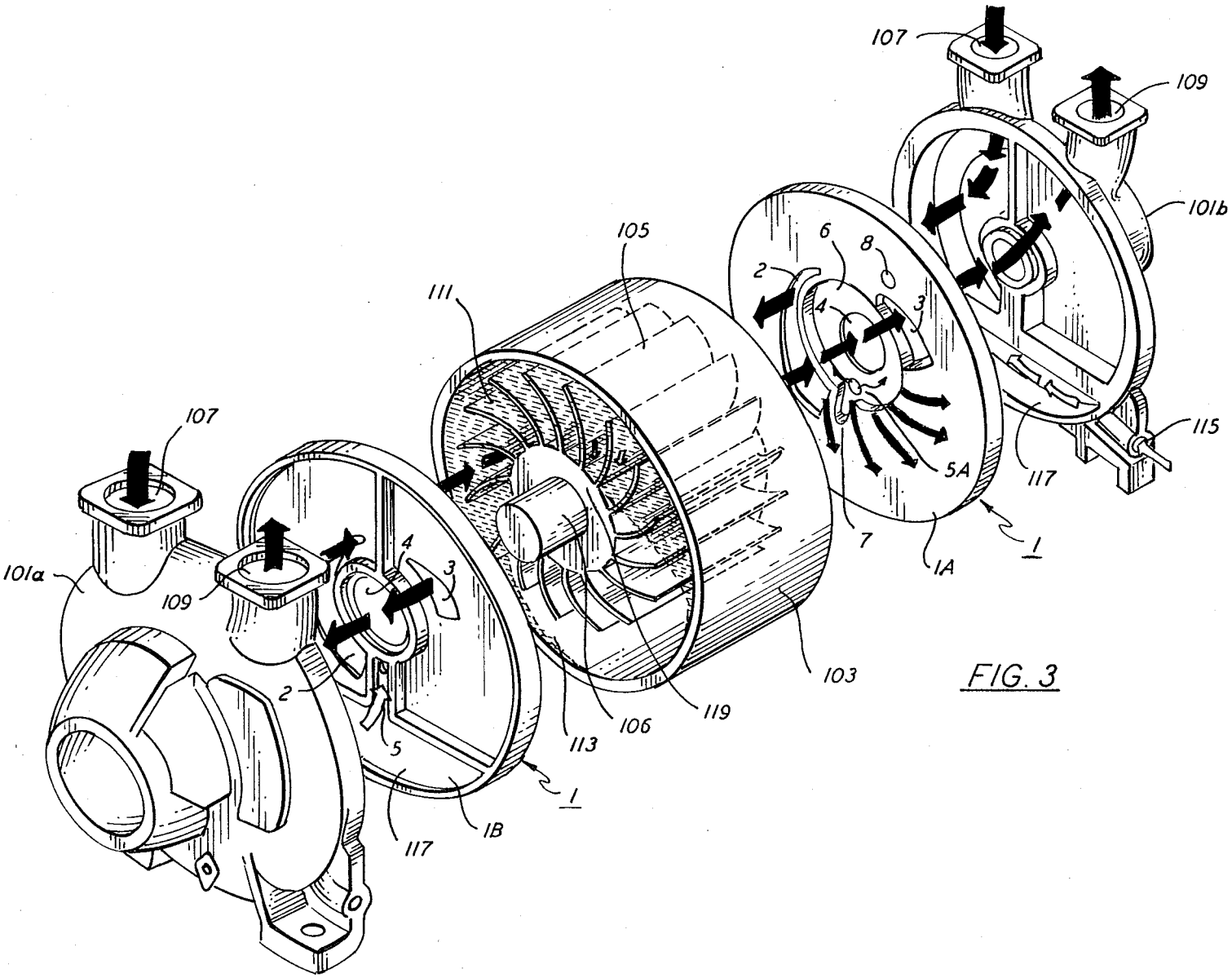
FIG. 3 is a perspective view of a vacuum pump according to the present invention.

FIG. 3 is an exploded perspective view of the liquid ring vacuum pump of the present invention. The liquid ring vacuum pump has first and second end bells 101*a* and 101*b*. These end bells mate with a machine housing 103 which eccentrically surrounds an impeller 105. The end bells support an impeller shaft 106. Each of the end bells has an inlet 107 for the gas to be compressed and an outlet 109 for the compressed gas. The individual blade chambers 111, i.e., the spaces between the blades, are closed off at their outer circumference by a liquid ring 113. The inlets and outlets 107 and 109 are in communication with the blade chambers 111 of the impeller through suction and pressure slots 2 and 3, respectively, formed in flat control discs 1 disposed between the end bells 101*a* and 101*b* and the machine housing 103. In the end bells 101*a* and 101*b* are formed inlets 115 for a pressurized liquid. These communicate with pressurized liquid canals or in pressurized liquid inlet 5 in the end bell located between the inlets 107 and outlets 109. Pressurized liquid flow from a sump 117 into inlet 5*a* which is below the shaft passage 4 in the control discs 1 seen in the end face 1B. An outlet 5*a* from inlet 5 can be seen in the side of the disc/adjacent the impeller hub 119, so that pressurized liquid flows off into the liquid ring sealing the gap.

Because of the eccentricity and the liquid ring, the liquid in each of the blade chambers 111 acts as a piston which, at the top of the impeller blade of FIG. 3, is completely closed. As the impeller rotates in a counter clockwise direction, the liquid effectively moves outwardly drawing the gas to be compressed in through the inlets 107 over the arc of the suction slot 2. The gas is then compressed by the inwardly moving liquid with compression continuing until the discharge slot 3 is reached, at which point the compressed gas is discharged through slot 3, the end bells and outlets 109.

In liquid ring vacuum pumps of the type under consideration here, the impeller, with blades arranged at the circumference of its impeller hub, is disposed eccentrically in a machine housing. The impeller shaft extends through shaft passages 4 of flat control discs 1 which, for instance, cover the machine housing on both sides and which in turn are covered on the outside by end bells. The control discs 1 have separate inlets and outlets for the medium to be pumped in the case of the described double flow pump. These inlets and outlets are in communication, via suction slots 2 and output slots 3 in the control discs 1, with the blade chambers which are closed off at the circumference of the pump by a liquid ring which corotates with the blade wheel within the machine housing. Between the inlets and outlets, respective liquid canals are provided in the end bells, which are connected to a pressurized liquid feed line located outside of the machine. These lead to pressurized liquid inlet 5 and to pressurized liquid passages, such as passage 6, in the control discs 1.

Figure 1:
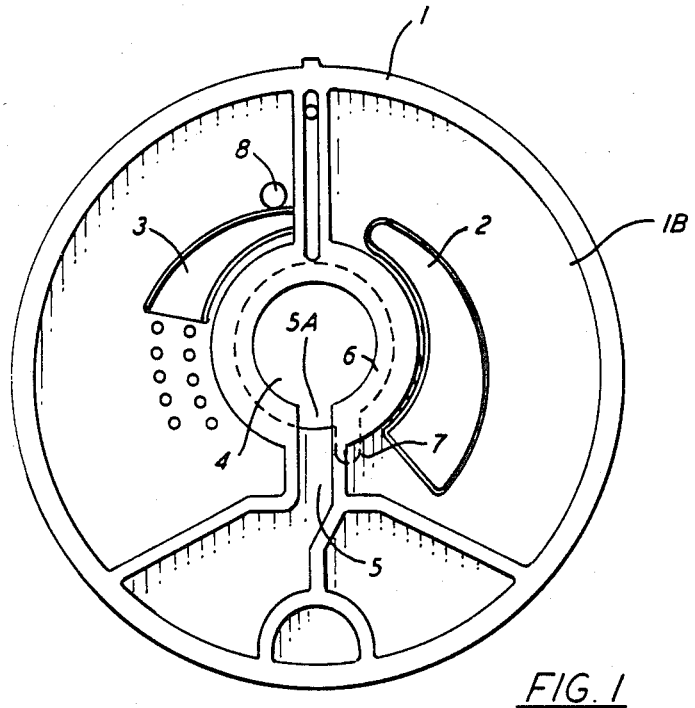
FIG. 1 is a plan view onto the side of the control disc which faces the end bell with an inlet and outlet.
Figure 2:
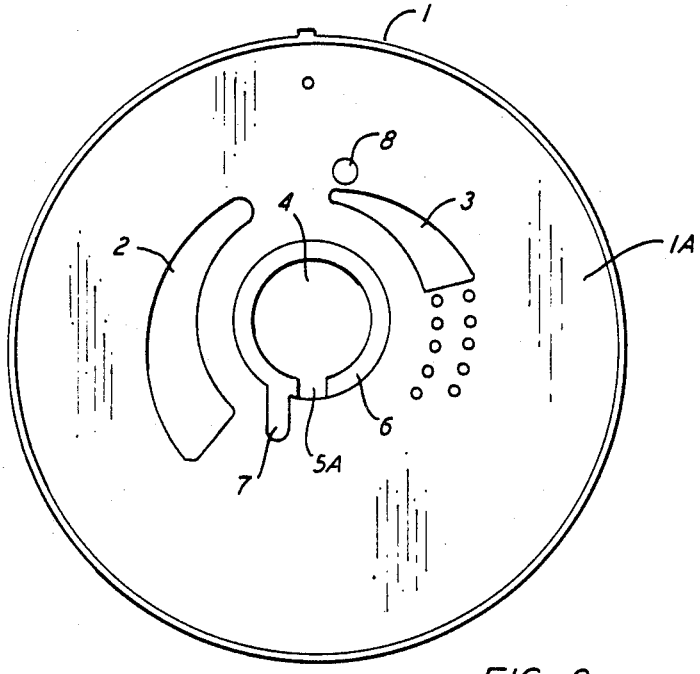
FIG. 2 is a plan view onto the side of the control disc facing the impeller.

The pressurized liquid passage 6 is designed, on side 1A, (FIG. 2) as a circular slot which surrounds the shaft passage 4 and into which an inflow channel 7 arranged on the side 1A opens from the outer circumference. Pressurized liquid from the end bell enters liquid inlet channel 5 on side 1B (FIG. 1). The location of this inlet channel 5 is between the suction slot 2 and output slot 3. Pressurized liquid flows through a slot 5A to the passage 6 on side 1A of the control disc 1. The inflow channel 7 directs the gap sealing pressurized liquid without turbulence in the direction of the rotating liquid ring and into the liquid ring. The inflow channel 7 is arranged as a milled slot between the suction slot 2 and the output slot 3, as seen in the direction of rotation of the impeller, and below the shaft passage 4, parallel to a diameter axis located between the suction and the output slots, i.e., a diameter axis which intersects neither slot. Under some circumstances, several inflow channels may also be provided.

In many cases, a liquid ring vacuum pump is connected to a separator at the outlet of each end bell which is connected via a line to the pressurized liquid inlet 5, instead of to a liquid return, as is commonly known.

With such a vacuum pump, larger suction volumes can be pumped with reduced gap losses and with better efficiency with low suction pressures up to about 60 mbar in circular operation, without erosion-prone scooping tubes and without separate pressure booster pumps, while the external working liquid control is simplified. In addition, the erosion damage which otherwise occurs in the region of what are called "circulating liquid holes" of the control discs cannot occur at all because of the elimination of such circulating liquid holes because the suction liquid line is eliminated.

In vacuum pumps which operate in the range of higher suction pressures, approximately from 180 mbar on, an improvement of the efficiency without simultaneous transportation of liquids, or an improvement of the running properties and a reduction of the power required with simultaneous transportation of liquids is obtainable by arranging additional relief passages 8 in the control discs 1.

Above each pressure, i.e., output slot 3 and separated therefrom, a relief passage 8 is arranged adjacent to the outer contour, in the form of a hole above the end of the pressure slot. This passage 8 is covered by the rotating liquid ring if liquid is pumped simultaneously.

Figure 4:
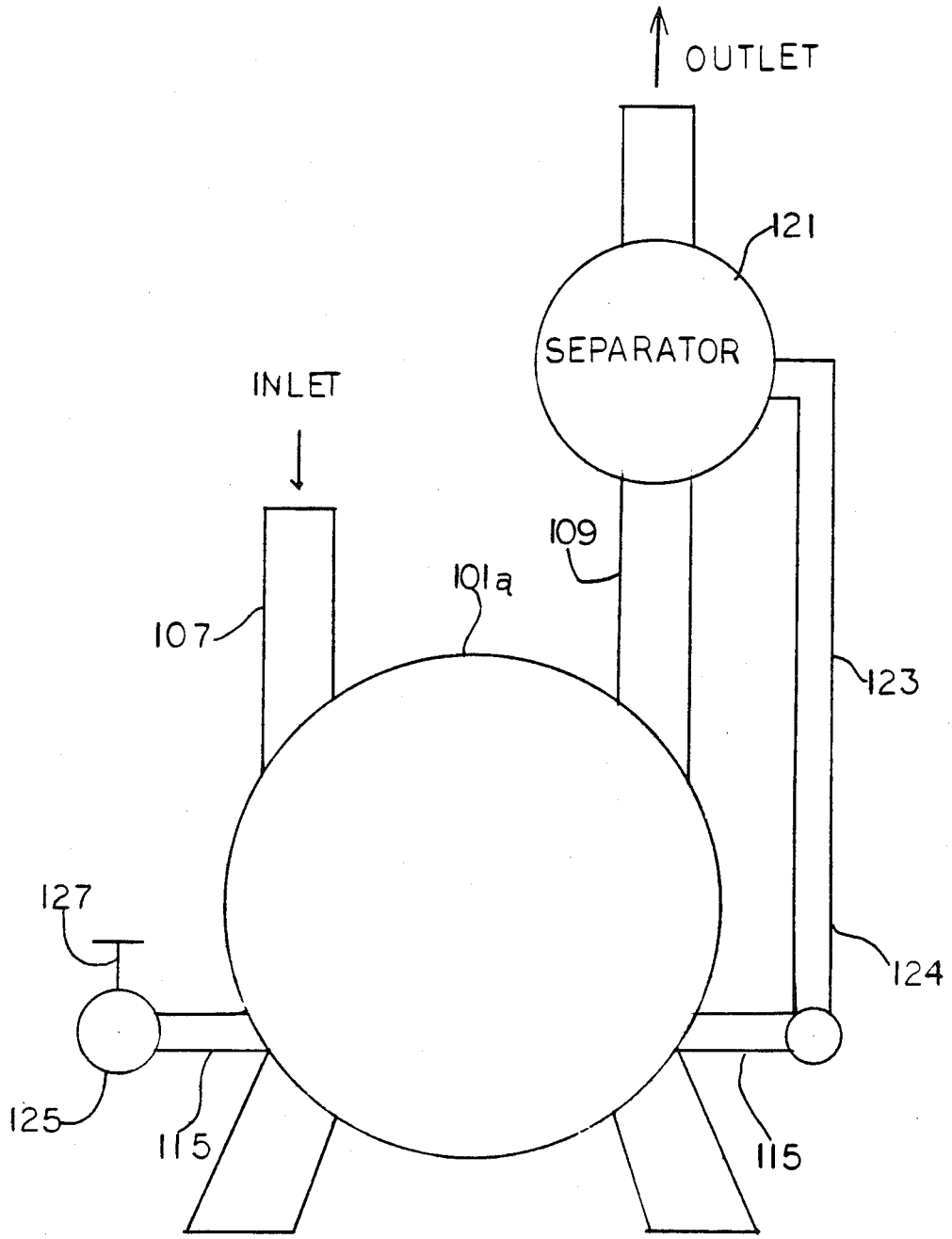
FIG. 4 is a schematic illustration of a vacuum pump arrangement with a separator.

FIG. 4 illustrates one of the end bells 101*a* and illustrates the inlet 107 and outlet 109. The outlet 109 is provided to a separator 121 where the liquid which is carried along the gas is separted out. This liquid is fed back over a line 123 to a sump line 124 between the inlets 115 at the two ends. On the other side is line 125 supplying the pressurized liquid. Inlet 115 on the other side are coupled to pressurized liquid feed line 125 which is supplied from a valve 127 with liquid under pressure. Thus, it becomes possible, when using a separator such as the separator 121 to recirculate operating liquid to the sump 117 of FIG. 1, which will be under pressure due to the pressure at the output of the pump from the separator. Alternatively, when there is no separator, sump 117 is in communication only with the pressurized liquid feed line 125.

The liquid forming the liquid ring continually enters the space between the control disc and impeller in the machine housing. The liquid and the gaseous medium emerge at the output slot 3. An increase in the liquid quantity supplied leads to higher compression at the crest of the control disc and entails an inadmissible power requirement increase. Passage 8 lets the part of the rotating liquid ring no longer required for the seal enter the space between control disc and end bell before the crest of control disc 1, the inadmissible power requirement increase thus being prevented.

What is claimed is:

1. In a liquid ring vacuum pump for a gaseous medium which includes a machine housing which surrounds an impeller eccentrically and is closed off at the end face by end bells for the impeller shaft, at least one end bell having a separate inlet and outlet for the medium, which are in communication, via suction and pressure slots in a flat control disc disposed between the end bell and the machine housing, with a gap between blade chambers of the impeller and the housing closed off on the circumference by a liquid ring, a pressurized liquid canal being provided in the respective control disc, said canal connected to a pressurized liquid feed line and aligned with the inlet to a pressurized liquid passage in the control disc, which is arranged below the shaft passage of the control disc at the end face facing the impeller hub, so that the pressurized liquid flows off into the liquid ring, sealing the gap, the improvement comprising the control disc having on the side facing the impeller at least one inflow channel located between the suction slot and the pressure slot as seen in the direction of rotation of the impeller, and below the shaft passage, said inflow channel extending radially over the region of the impeller hub up to the region of the blade chambers and being connected to the pressurized liquid passage; and a sump, the pressurized liquid feed line connected to the pressurized liquid canal in the control disc through said sump.

2. The improvement according to claim 1 and further including a separator following the outlet of the end bell; and a line feeding liquid separated out back to said sump.

3. The improvement according to claim 1, wherein a single inflow channel is arranged parallel to and spaced from a diameter axis of the control disc located between the suction and the pressure slots and comprises a milled slot.

4. The improvement according to claim 1 or 2 for the selectably simultaneous transport of liquids with gaseous media and further including at least one relief passage for the liquid ring, formed in the control disc, above and separated from the pressure slot and adjacent its outer contour.

5. The improvement according to claim 4, wherein said relief passage comprise a bore hole above one end of the pressure slot.

* * * * *